US005494146A

United States Patent [19]

Kurosawa et al.

[11] Patent Number: 5,494,146

[45] Date of Patent: Feb. 27, 1996

[54] COIN SELECTOR

[75] Inventors: Hironobu Kurosawa, Isesaki; Toshitomo Kuwabara, Kiryu; Kazuo Shimizu, Isesaki, all of Japan

[73] Assignee: Sanden Corporation, Japan

[21] Appl. No.: 267,355

[22] Filed: Jun. 29, 1994

[51] Int. Cl.[6] ..... G07D 5/08

[52] U.S. Cl. ..... 194/317; 194/346

[58] Field of Search ..... 194/202, 203, 194/317, 318, 319, 346

[56] References Cited

U.S. PATENT DOCUMENTS

| | | | |
|---|---|---|---|
| 4,106,610 | 8/1978 | Heiman | 194/317 |
| 5,020,653 | 6/1991 | Shimizu | 194/317 |
| 5,024,313 | 6/1991 | Miyazawa | 194/217 |
| 5,050,719 | 9/1991 | Shimizu | 194/202 |
| 5,052,538 | 10/1991 | Satoh | 194/317 |
| 5,112,275 | 5/1992 | Sato | 453/5 |
| 5,131,518 | 7/1992 | Shimizu | 194/318 |
| 5,145,046 | 9/1992 | Satoh | 194/203 |
| 5,167,313 | 12/1992 | Dobbins et al. | 194/317 |
| 5,181,882 | 1/1993 | Miyazawa | 453/63 |

*Primary Examiner*—F. J. Bartuska
*Attorney, Agent, or Firm*—Banner & Allegretti, Ltd.

[57] ABSTRACT

A coin selector for use in a coin mechanism of vending machines and the like is disclosed. The coin selector includes a device which determines whether a deposited coin is real or fake, and a movable gate which selectively conducts the deposited coin into a real coin chute or a fake coin chute in response to an operational result of the determining device. A detector is positioned upstream of the entrances to the real coin chute and the fake coin chute, and outputs an electrical signal which is dependent upon the position of the gate and the moving condition of the coin as it passes by the detector. The coin selector further includes a judging circuit which receives the output from the detector and determines whether the gate is in position to conduct the coin into the real coin chute or the fake coin chute. The judging circuit independently determines, based on the assumption that the gate is position to conduct the coin into the real coin chute, whether it can be concluded that the coin was in position to go into the real coin chute. If it is determined both that the gate was in position to conduct the coin into the real coin chute and that the coin was in position to be so conducted, the judging circuit outputs a signal indicating that the coin went into the real coin chute.

18 Claims, 11 Drawing Sheets

COIN SELECTOR

BACKGROUND OF THE INVENTION

1. Field of the Invention

This invention relates to a coin mechanism for use in vending machines and the like, and more particularly to a coin selector of the coin mechanism.

2. Description of the Prior Art

A conventional coin selector includes a discriminating device which discriminates as to the authenticity and denomination of the deposited coins and a sorting device which sorts the deposited coins in response to the operating result of the discriminating device. One such conventional coin selector is schematically illustrated in FIG. 1. With reference to FIGS. 1 and 2, coin selector 10 includes housing 11 which houses discriminating device 20 and sorting device 30 which is operationally connected to discriminating device 20. Housing 11 is provided with a coin slot 111 which is formed at a top end surface of housing 11. Discriminating device 20 includes a conventional control device (not shown) which is operationally connected to sorting device 30 and first or entry chute 21 which is fixedly disposed within housing 11. When coin-like object 40 is deposited into housing 11 through slot 111, first chute 21 receives deposited object 40 at one end portion thereof. First chute 21 allows deposited object 40 to roll from one end portion to the other end portion thereof. Discriminating device 20 further includes first, second and third magnetic detectors 22, 23 and 24, which are connected to the control device. Detectors 22, 23 and 24 are fixedly disposed within housing 11 along first chute 21 to detect the material composition, thickness and diameter of the deposited coin-like object 40, respectively, when object 40 passes by the detectors. Detectors 22, 23 and 24 generate electric signals representing the detected composition, thickness and diameter of deposited object 40, respectively. The electric signals are input to the control device to be electrically processed therein. The control device discriminates between authentic and fake coins, and if deposited object 40 is an authentic coin, control device determines the denomination.

Sorting device 30 includes second through fifth chutes 31–34, and first and second gates 301 and 302. Second and third chutes 31 and 32 are formed by wall or panel 42 which substantially bifurcates first chute 21 at the terminal end thereof. Fourth and fifth chutes 33 and 34 are formed by wall or panel 43 which substantially bifurcates third chute 32 at the terminal end thereof. First gate 301 is provided above the location at which second and third chutes 31 and 32 are forked. Second gate 302 is provided above the location at which fourth and fifth chutes 33 and 34 are forked. First gage 301 operates to selectively conduct deposited object 40, which has just passed through first chute 21, into either second chute 31 or third chute 32 in response to the operational result of the control device. Second gage 302 operates to selectively conduct deposited object 40, which has just passed through third chute 32, into either fourth chute 33 or fifth chute 34 in response to the operational result of the control device.

In operation, when deposited object 40, as it is passing through first chute 21, is judged by the control device to be a fake coin, first gate 301 operates to conduct deposited object 40 into second chute 31. Thus, second chute 31 is generally called a fake coin chute. On the other hand, when deposited object 40, as it is passing through first chute 21, is judged by the control device to be a real coin, for example, a Japanese coin of 10 yen, 50 yen, 100 yen or 500 yen, first gage 301 operates to conduct deposited object 40 into third chute 32. Thus, third chute 32 is generally called a real coin chute. Furthermore, when deposited object 40, as it is passing through first chute 21, is judged by the control device to be a real coin of either 10 yen or 50 yen, first and second gates 301 and 302 operate to conduct the real coin into fourth chute 33 via real coin chute 32. When deposited object 40, as it is passing through first chute 21, is judged by the control device to be a real coin of either 100 yen or 500 yen, first and second gates 301 and 302 operate to conduct the real coin into fifth chute 34 via real coin chute 32.

Though not illustrated in FIG. 1, sorting device 30 would include a third gate provided at the terminal end of fourth chute 33 and a fourth gate provided at the terminal end of fifth chute 34. The third gate would operate to sort and conduct a real 10 yen or 50 yen coin which had been conducted into fourth chute 33 by operation of gate 302, into one of a first and second containers (not shown) provided at the terminal end of fourth chute 33, in dependence upon the operational result of the control device, that is, the determined value of the coin. The fourth gate would act in a similar manner to sort and conduct 100 yen and 500 yen coins from fifth chute 34 into one of a third and fourth containers (not shown) provided at the terminal end of fifth chute 34, in dependence upon the operational result of the control device.

Each of the first through fourth containers would be provided with a photo-sensor, such as a phototube disposed at an upper end portion thereof. Each of the phototubes senses whether the container is completely filled with corresponding real coins, and generates an electric signal when the container is completely filled with the corresponding real coins. The electric signal generated at the phototube is input to the control device to be electrically processed therein. In operation, when at least one of the first through fourth containers is completely filled, and the deposited object is judged by the control device to be a real coin corresponding to that container, the judged real coin is conducted into a sixth chute (not shown) via real coin chute 32 by virtue of operation of a fifth gate (not shown) which operates in response to the operational result of the control device. The judged real coin conducted into the sixth chute is stored in a fifth container (not shown), provided at a terminal end of the sixth chute and which serves as an over-flow container.

FIG. 2 illustrates a schematic construction of a part of the conventional coin selector. In FIG. 2, for purposes of explanation only, the left side of the figure will be referenced as the forward end or front of the coin selector, and the right side of the figure will be referenced as the rearward end or rear of the coin selector. The coin selector includes a first vertical panel 41 which is vertically and fixedly disposed within housing 11 of the coin selector. First vertical panel 41 defines a columnar cavity 51 in cooperation with front panel 11*a* of housing 11. An upper end of columnar cavity 51 is substantially in communication with the terminal end of first chute 21 which is depicted in FIG. 1. Second vertical panel 42 is vertically and fixedly disposed within columnar cavity 51 so as to bifurcate columnar cavity 51 into a first columnar cavity section 31 forward of second vertical panel 42 which serves as the second or fake coin chute, and a second columnar cavity section 32 to the rear of second vertical panel 42 which serves as the third or real coin chute 32. Third vertical panel 43 is disposed within second columnar cavity section 32 so as to bifurcate second columnar cavity section 32 into a third columnar cavity section 33 forward of third vertical panel 43 which serves as the fourth chute, and a fourth columnar cavity section 34 to the rear of third vertical panel 43 and which serves as the fifth chute.

First and second gates 301 and 302 are disposed through first vertical panel 41. First gate 301 is slidably received in first hole 41*a* which is formed through first vertical panel 41. First solenoid 310 is located at a position to the rear of first gate 301 and is associated therewith. First solenoid 310 includes cylindrical plunger 311 of steel and a solenoid coil (not shown) which surrounds a rear portion of plunger 311 with a radial air gap. Plunger 311 slidably penetrates through front wall 341 of casing 340 which contains first solenoid 310. A front end surface of plunger 311 is fixedly connected to a rear end surface of first gate 301. Coiled spring 311*a* is resiliently disposed about plunger 311 between the front end surface of front wall 341 of casing 340 and the rear end surface of first gate 301 so that first gate 301 is urged forwardly by virtue of the resilient force of coiled spring 311*a*. The forward movement of first gate 301 is limited by contact of first vertical panel 41 and radial projection 301*a* which is formed at the rear end portion of first gate 301. Thus, when the solenoid coil of first solenoid 310 is not excited, first gate 301 is maintained at the position depicted by the dashed line in FIG. 3 due to the restoring resilient force of coiled spring 311*a*. When the solenoid coil of first solenoid 310 is excited, plunger 311 and therefore first gate 301 are moved rearwardly against the restoring force of spring 311*a*, as shown in the solid lines.

With reference to FIG. 4, second gate 302 includes pivoting member 302*a* and reciprocating member 302*b* which is operatively connected to pivoting member 302*a* through pin member 302*c* which is fixedly secured to an upper portion of pivoting member 302*a*. Pivoting member 302*a* pivotally moves about pivot pin 302*d* which is fixedly disposed within real coin chute 32 at a position which is located just above the upper end of third vertical panel 43. Reciprocating member 302*b* is slidably received in second hole 41*b* which is formed through first vertical panel 41 below first hole 41*a*. Reciprocating member 302*b* moves forwardly and rearwardly in accordance with the movement of plunger 321 of second solenoid 320. As reciprocating member 302*b* moves rearwardly and forwardly, pivoting member 302*a* pivots about pivot pin 302*d* in the clockwise and counterclockwise directions, respectively.

Reciprocating member 302*b* of second gate 302 is associated with second solenoid 320 which is located at a position to the rear of reciprocating member 302*b*. Second solenoid 320 is contained within casing 340, and includes steel cylindrical plunger 321 and a solenoid coil (not shown) which surrounds a rear portion of plunger 321 with a radial air gap. Plunger 321 slidably penetrates through front panel 341 of casing 340. A front end surface of plunger 321 is fixedly connected to a rear end surface of reciprocating member 302*b*. Coiled spring 321*a* is resiliently disposed about plunger 321 between the front end surface of front panel 341 of casing 340 and the rear end surface of reciprocating member 302*b* so that reciprocating member 302*b* is urged forwardly by virtue of the resilient restoring force of coiled spring 321*a*. Forward movement of reciprocating member 302*b* is limited by contact of first vertical panel 41 and radial projection 302*e* which is formed at a lower rear end portion of reciprocating member 302*b*.

Reciprocating member 302*b* and therefore pivoting member 302*a* are maintained by spring 321*a* at the forward position depicted by the dashed line in FIG. 4 whenever the solenoid coil of second solenoid 320 is not excited. When the solenoid coil of second solenoid 320 is excited, plunger 321 and therefore reciprocating member 302*b* are moved rearwardly against the restoring force of spring 321*a*, causing pivoting member 302*a* to be pivoted clockwise about pivot pin 302*d*, as shown in the solid lines.

Fourth magnetic detector 25' is fixedly disposed within first vertical panel 41 at a position which is located between plungers 311 and 321. A front end surface of detector 25' is flush with a front end surface of first vertical panel 41 and is exposed to the upper end portion of columnar cavity 51, near the upper end of real coin chute 32. Fourth magnetic detector 25' continually generates a magnetic flux which extends into cavity 51, and detects the condition of the magnetic flux path, which is affected by the presence of an object conducted into cavity 51. Detector 25' generates an electric signal representing this condition, and inputs the signal to the control device, which electrically processes the signal so as to determine whether an object which has been judged to be a real coin is, in fact, conducted into real coin chute 32.

With reference to FIGS. 1–4, the operation of first and second gates 301 and 302 is described in further detail. When deposited object 40, as it passes through first chute 21, is determined by the control device to be a fake coin, the solenoid coil of first solenoid 310 is not excited, so that plunger 311 and therefore first gate 301 are located at the position depicted by the dashed line in FIG. 3. Therefore, real coin chute 32 is blocked by the forward end of gate 301, and deposited object 40 is conducted into fake coin chute 31, as depicted by solid arrow "A" in FIG. 2.

Alternatively, when deposited object 40, as it is passing through first chute 21, is determined by the control device to be a real coin, the solenoid coil of first solenoid 310 is excited. Plunger 311 and therefore first gate 301 are located at the position depicted by the solid line in FIG. 3. Therefore, real coin chute 32 is not blocked by gate 301, and coin 40 is conducted into real coin chute 32. Simultaneously, the control device determines the value of coin 40, and if coin 40 is determined to be a 10 yen or 50 yen coin, the solenoid coil of second solenoid 320 is exited. Accordingly, simultaneously with movement of plunger 311, plunger 321 and reciprocating member 302*b* are moved to the rearward position depicted by the solid line in FIG. 4. As reciprocating member 302*c* moves rearwardly, pivoting member 302*a* also pivots in a clockwise direction about pivot pin 302*d* to be located at the position depicted by the solid line in FIG. 4, opening chute 33 and blocking chute 34. Accordingly, deposited object 40 which is determined to be a real 10 yen or 50 yen coin is conducted into real coin chute 32 and then into fourth chute 33 as depicted by dashed arrow "B" in FIG. 2.

If the control device determines that deposited object 40 which passes through first chute 21 is a real coin having a value of 100 yen or 500 yen, the solenoid coil of first solenoid 310 is excited and the solenoid coil of second solenoid 320 is not excited. Accordingly, plunger 311 of first gate 301 is moved to the position depicted by the solid line in FIG. 3, and simultaneously, plunger 321 and reciprocating member 302*b* are maintained in the forward position depicted by the dashed line in FIG. 4. Since reciprocating member 302*b* is maintained at the forward position, pivoting member 302*a* also is maintained at the position depicted by the dashed line in FIG. 4. Accordingly, deposited object 40 which is determined to be a real 100 or 500 yen coin is conducted into real coin chute 32 and then into fifth chute 34 as depicted by dashed arrow "C" in FIG. 2. As discussed above, the third and fourth gates also could be controlled in a similar manner to further separate the 10 yen coins from the 50 yen coins, and the 100 yen coins from the 500 yen coins, respectively.

With reference to FIGS. 2, 5 and 6, the manner in which the control device operates to determine whether deposited object 40, which has been determined to be a real coin, actually is conducted into real coin chute 32, is described. It is important to make this determination since, if the real coin erroneously is conducted to the fake coin chute and thus returned to the customer, the control device still will record that the value of the coin has been inserted into the machine.

When a real coin has just passed by fourth magnetic detector 25', the path of the magnetic flux is transformed and an electric signal representing the transformation is generated by fourth magnetic detector 25'. The electric signal generated is inputted to the control device and is electrically processed therein, to have a pike $W_1$ or a pike $W_2$ as shown in FIG. 5, in dependence upon the position of the object relative to detector 25' when it passes through the magnetic flux. In FIG. 5, pike $W_1$ represents the situation where a real coin, which ultimately will be conducted into the real coin chute 32, has just passed by fourth magnetic detector 25'. Pike $W_2$ representatively shows the situation where a real coin, which ultimately will be conducted into fake coin chute 31 in error, has just passed by fourth magnetic detector 25'. A real coin 40 erroneously may be conducted into fake coin chute 31 in error, due to, for example, a defective movement of first gate 301 caused by dusts or the like disposed between first hole 41*a* and first gate 301 or between plunger 311 and coiled spring 311*a*.

The pikes $W_1$ and $W_2$ have a peak $P_1$ and a peak $P_2$, respectively. Peak $P_1$ is greater than peak $P_2$ because a real coin, which will be conducted into real coin chute 32, will pass by closer to fourth magnetic detector 25' than a real coin which erroneously will be conducted into fake coin chute 31. Since a real coin, which will be conducted into real coin chute 32 or fake coin chute 31, passes by fourth magnetic detector 25' under varying conditions, for example, at various inclinations or various speeds, peaks $P_1$ and $P_2$ have varying values. Further, the values of the peaks varies in dependence upon the composition, weight and diameter of the coin, which depend upon the value of the coin. Statistically, the values of peak $P_1$ vary in a range as shown by the vertical solid line for each denomination of coin, in FIG. 6. Similarly, the values of peak $P_2$ vary in a range as shown by the vertical dashed line for each denomination of coin, in FIG. 6.

With further reference to FIG. 6, when the conventional coin selector is provided in one monetary system, such as for example, the monetary system in Japan, the determination of whether a real coin will be conducted into real coin chute 32 is carried out as follows. First, a reference value which will be compared with the detected value of the peak, is selected within a range $R_1$. The greatest value for range $R_1$ must be lower than the statistical lowest value of peak $P_1$ for a real coin of 10 yen, and the lowest value of range $R_1$ must be greater than the statistical greatest value of peak $P_2$ for a real coin of 500 yen. The peak values for the 10 yen and 500 coins are used since the ranges for these coins are the lowest and highest, respectively. Preferably, the reference value is selected to be a value which is the mean of the lowest and highest values of range $R_1$ in order to increase the reliability of the judgment.

Then, the detected value of the peak is compared with the reference value in the control device. When the detected value of the peak is higher than the reference value, the control device determines that the real coin will be properly conducted into real coin chute 32. On the other hand, when the detected value of the peak is lower than the reference value, the control device determines that the real coin will be erroneously conducted into fake coin chute 31 and returned to the customer. In the latter case, no credit is given for the coin.

Furthermore, when the conventional coin selector is provided for two monetary systems, such as, for example, the monetary system in Japan and the monetary system in the U.S.A., the determination of whether the real coin will be conducted into real coin chute 32 is carried out as follows.

First, a reference value which will be compared with the detected value of the peak is selected within a range $R_2$. The greatest value of range $R_2$ should be lower than the statistical lowest value of peak $P_1$ of a real 10 cents coin, and the lowest value of range $R_2$ should be greater than the statistical highest value of the peak $P_2$ Of a real 500 yen coin. Preferably, the reference value is selected to be a value which is the mean of the lowest and greatest values of range $R_2$ in order to increase the reliability of the determination.

Then, the detected value of the peak is compared with the selected reference value in the control device. When the detected value of the peak is higher than the reference value, the control device determines that a real coin will be conducted properly into real coin chute 32. On the other hand, when the detected value of the peak is lower than the reference value, the control device determines that the real coin erroneously is conducted into fake coin chute 31.

In general, when a conventional coin selector is provided for use with two or more monetary systems, the reliability of the determination of whether the real coin will be conducted into real coin chute 32 is diminished, because the reference value must be selected within a relatively narrow range due to the increase in the number of different coin denominations. In other words, the range $R_2$ is difficult to define because if the machine is designed for use with many currency systems each having many denominations of coins, the difference between the statistical greatest value of peak $P_2$ for the largest coin judged to be erroneously conducted into the fake coin chute may be very close to the statistical lower value of peak $P_1$ for the smallest coin judged to be conducted properly into the real coin chute. In some cases, the range within which the reference value must be selected cannot be defined at all due to the fact that the number of different denominations is so large, and the greatest value for peak $P_2$ may exceed the lowest value for peak $P_1$.

SUMMARY OF THE INVENTION

Accordingly, it is an object of the present invention to provide a coin selector in which a reliable judgment of whether a real coin is in fact conducted into a real coin chute can be made even when the denomination of the coins for which the judgment must be made is large, for example, where the coin selector is used for multiple currency systems.

A coin selector according to the present invention includes a coin chute into which coins deposited into the coin selector are initially conducted at an entry portion. The coin chute is divided at a location below the entry portion into a real coin path and a fake coin path. A discriminating mechanism discriminates between real coins and fake coins which are deposited into the coin selector and outputs an operational result indicating whether the deposited coin is real or fake. A conducting mechanism conducts the coin into either the real coin path or the fake coin path, and is located at a position above the location where the real coin path and the fake coin path are divided. The conducting mechanism is movable between a first position in which the coin is conducted into the real coin path and a second position in which the coin is conducted into the fake coin path in dependence upon the operational result of the discriminating mechanism. A detecting mechanism detects an operational condition of the conducting mechanism and a moving condition of the deposited coin at a time when the deposited coin passes by the location where the coin chute is divided, and outputs a signal indicative of the operation condition and the moving condition. A first comparing mechanism compares a predetermined first reference condition with the operational condition of the conducting mechanism and outputs an operational result of the comparison. A second comparing mechanism compares a predetermined second reference condition with the moving condition of the deposited coin and outputs an operation result of the comparison. A judging mechanism functions when a real coin is deposited, receives the operational result of the first comparing mechanism and the operational result of the second comparing mechanism, and outputs a signal indicating whether the deposited real coin is conducted into the real coin path based upon the moving condition of the coin and the operational condition of the conducting mechanism.

DETAILED DESCRIPTION OF THE PREFERRED EMBODIMENT

Figure 1:
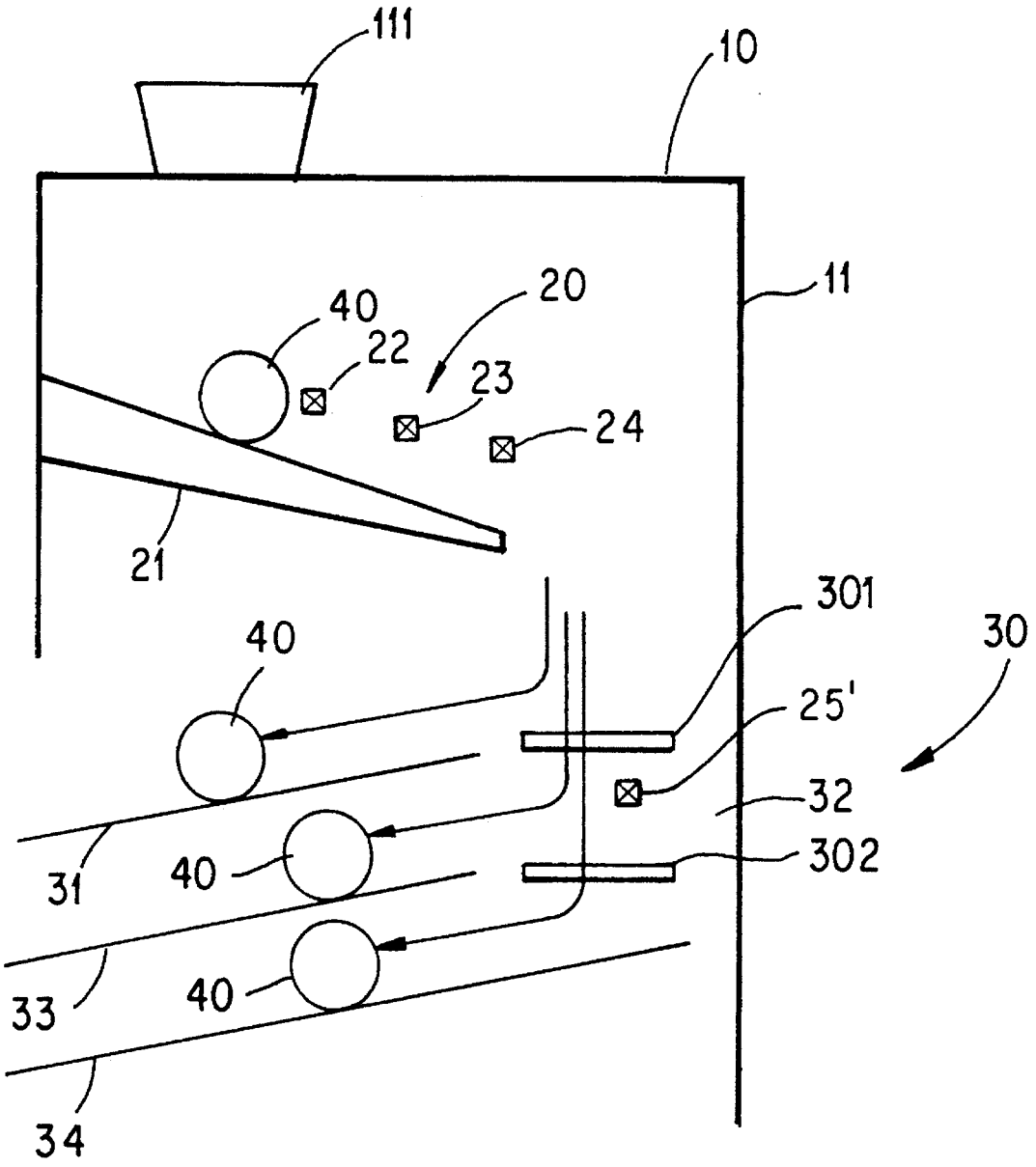
FIG.1 PRIOR ART
FIG. 1 is a schematic illustration of a conventional coin selector.
Figure 2:
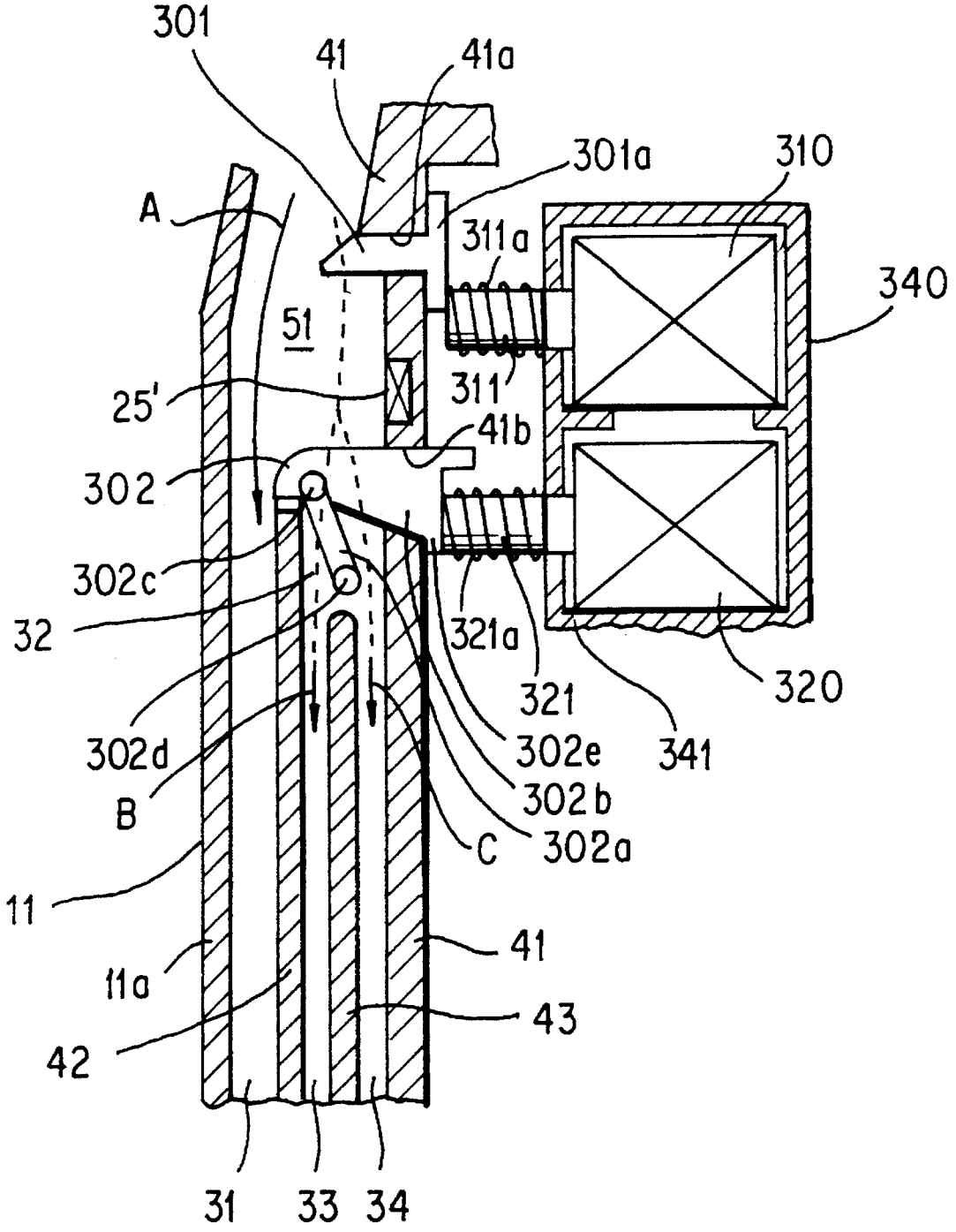
FIG. 2 PRIOR ART
FIG. 2 is a schematic sectional view of a part of the conventional coin selector shown in FIG. 1.
Figure 3:
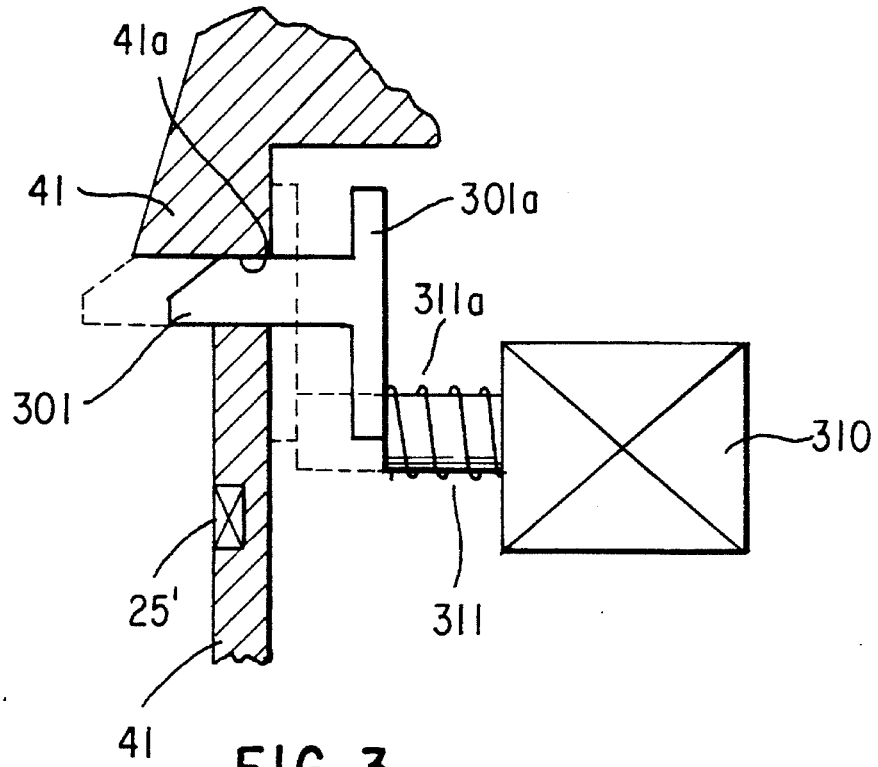
FIG. 3 PRIOR ART
FIG. 3 is an enlarged schematic sectional view illustrating a first gate shown in FIG. 2.
Figure 4:
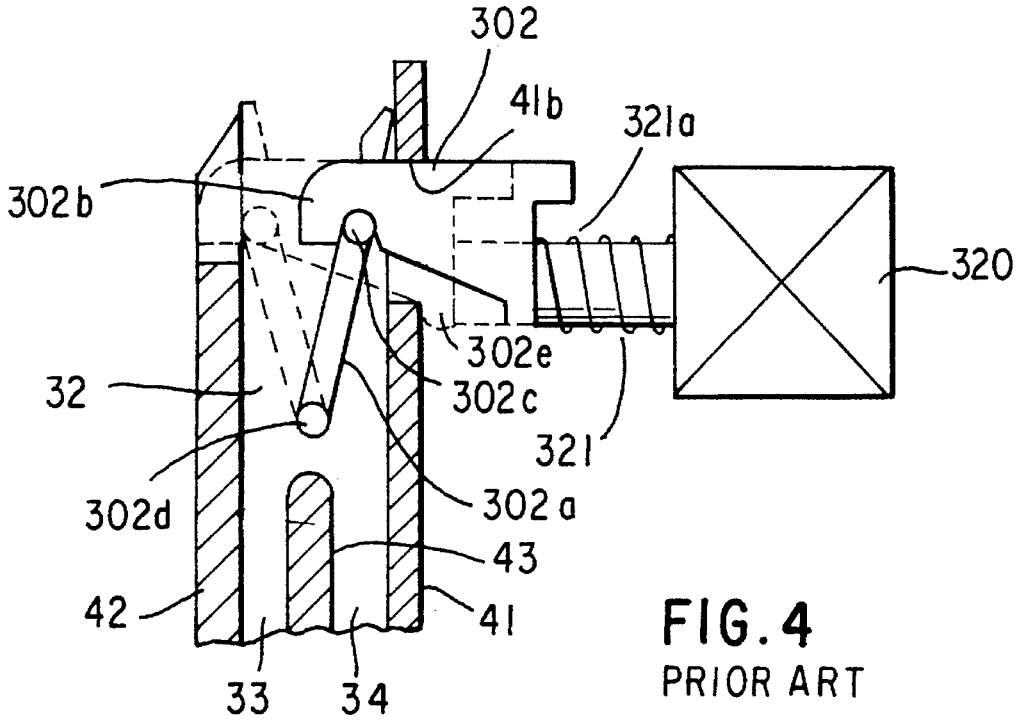
FIG. 4 PRIOR ART
FIG. 4 is an enlarged schematic sectional view illustrating a second gate shown in FIG. 2.
Figure 5:
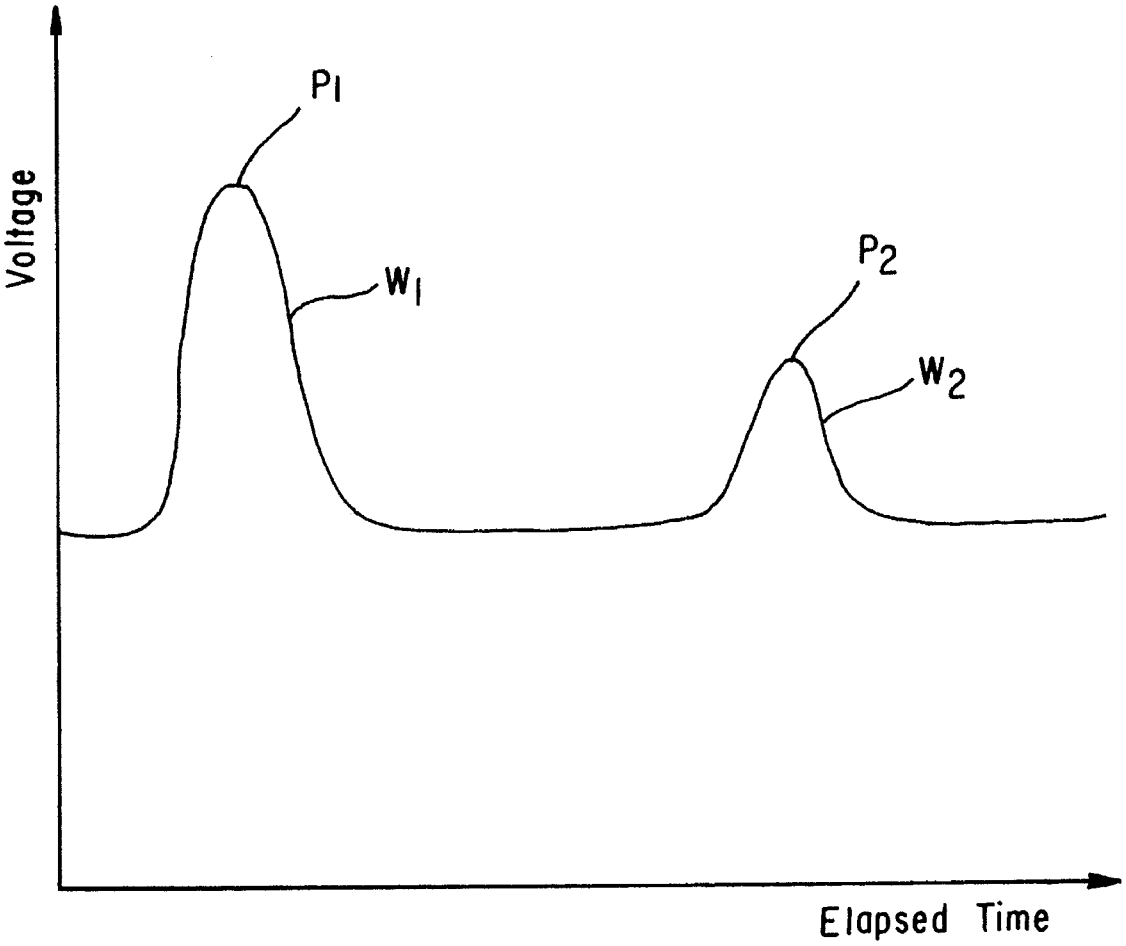
FIG. 5 PRIOR ART
FIG. 5 is a graph illustrating a characteristic of an electric signal generated at a fourth magnetic detector of a control device of the conventional coin selector.
Figure 6:
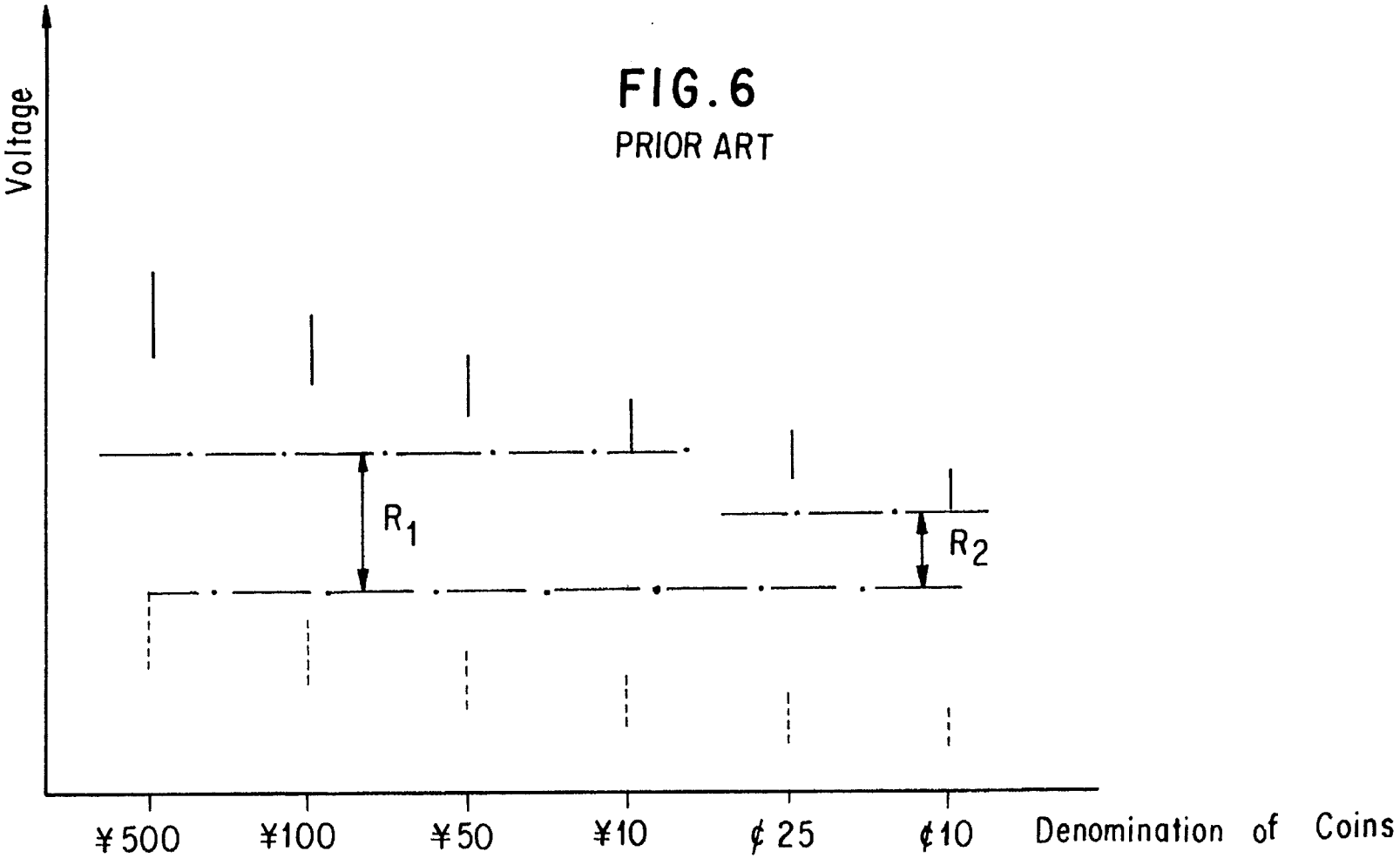
FIG. 6 PRIOR ART
FIG. 6 is a graph illustrating a statistical result of the characteristic shown in FIG. 5.

A coin selector in accordance with the present invention is shown in FIGS. 7–10. Elements of the coin selector according to the present invention which are substantially identical in structure and functioning to corresponding elements of the conventional coin selector illustrated in FIGS. 1–4 are identified by the same reference numeral, unless indicated to the contrary.

Figure 7:
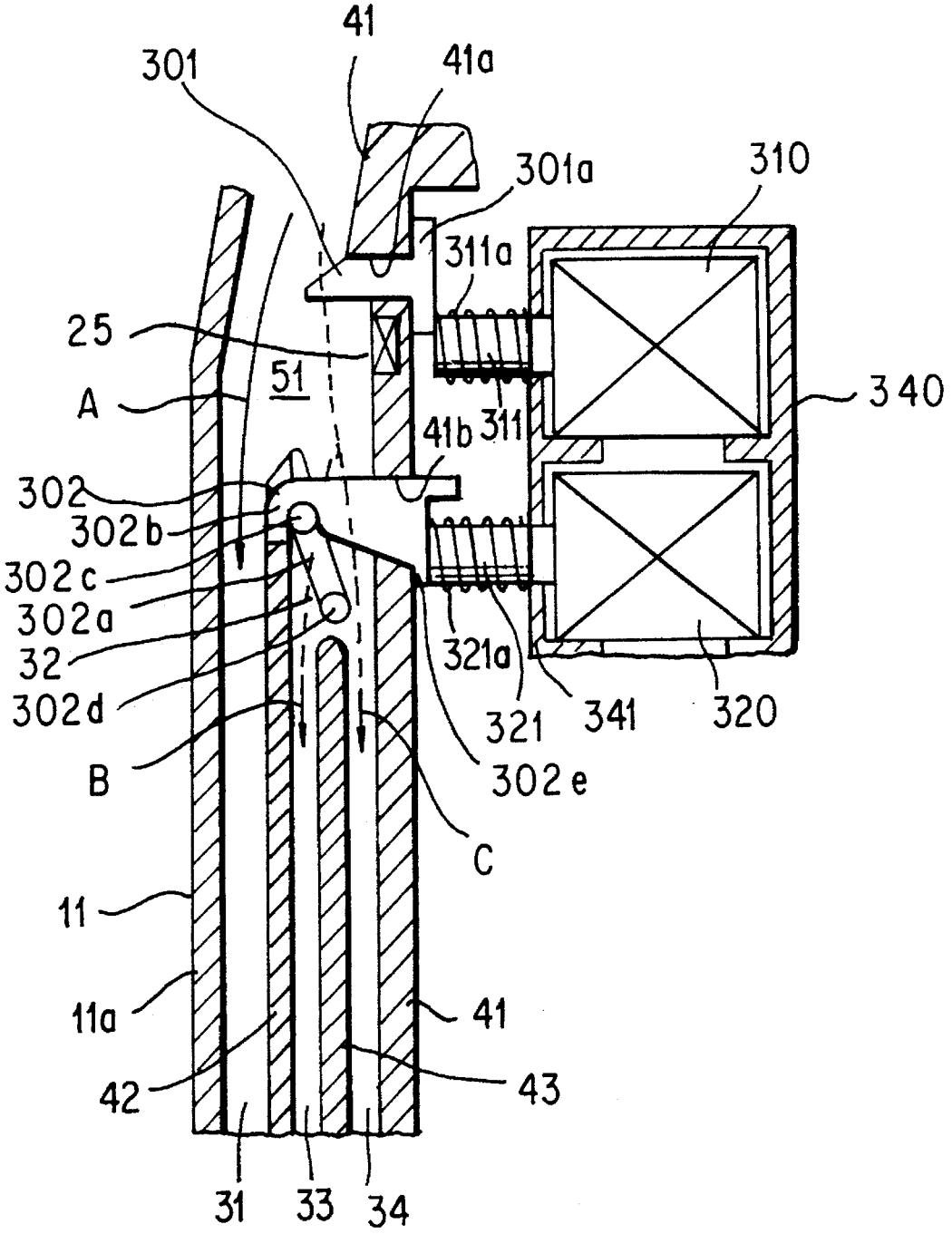
FIG. 7 is, a schematic sectional view of a part of a coin selector in accordance with the present invention.
Figure 8:
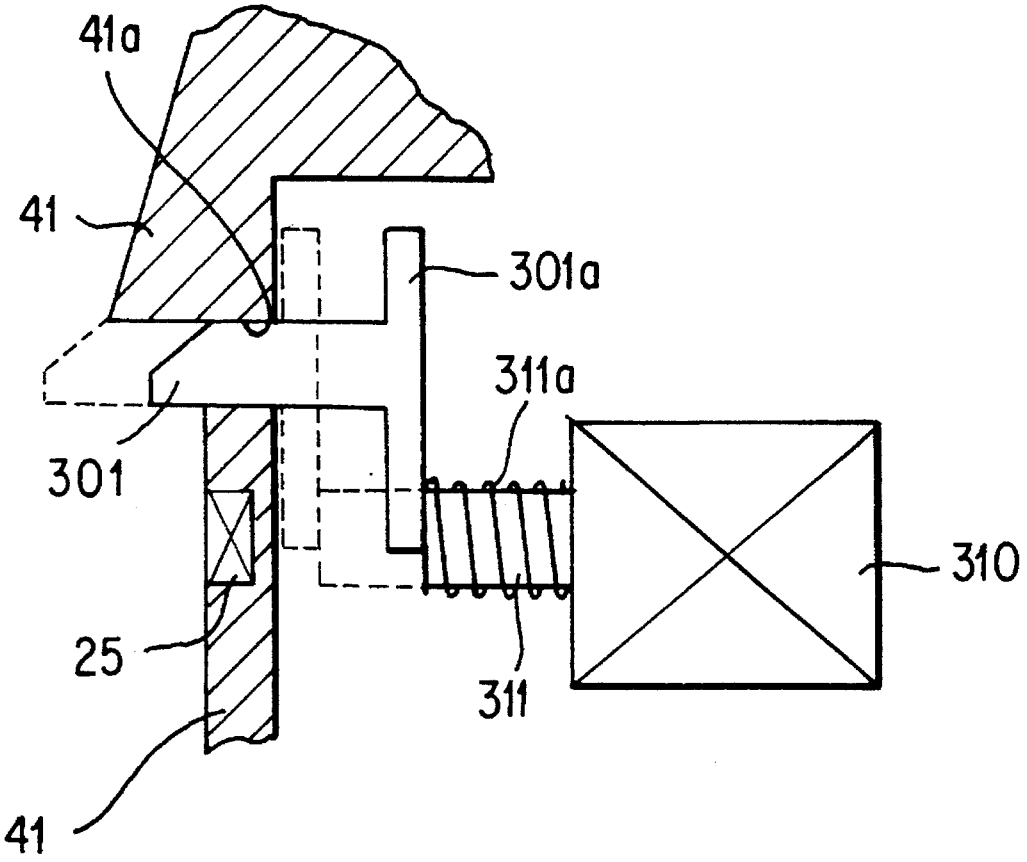
FIG. 8 is an enlarged schematic sectional view illustrating a first gate shown in FIG. 7.

With reference to FIGS. 7 and 8, a part of the coin selector in accordance with the present invention is shown. The same construction is accorded like numerals as shown with respect to FIGS. 2 and 3, and the description of some of the identical elements is substantially omitted. Furthermore, for purposes of explanation only, the left side of the figure will be referenced as the forward end or front of the coin selector, and the right side of the figure will be referenced as the rearward end or rear of the coin selector.

Fourth magnetic detector 25 is fixedly disposed within first vertical panel 41 at a position which is located directly in front of plunger 311. A front end surface of detector 25 is flush with a front end surface of first vertical panel 41 and is exposed to the upper end portion of columnar cavity 51. Fourth magnetic detector 25 continually generates and detects a condition of a path of magnetic flux, and continually generates a first electric signal $S_1$ representing this condition.

Figure 9:
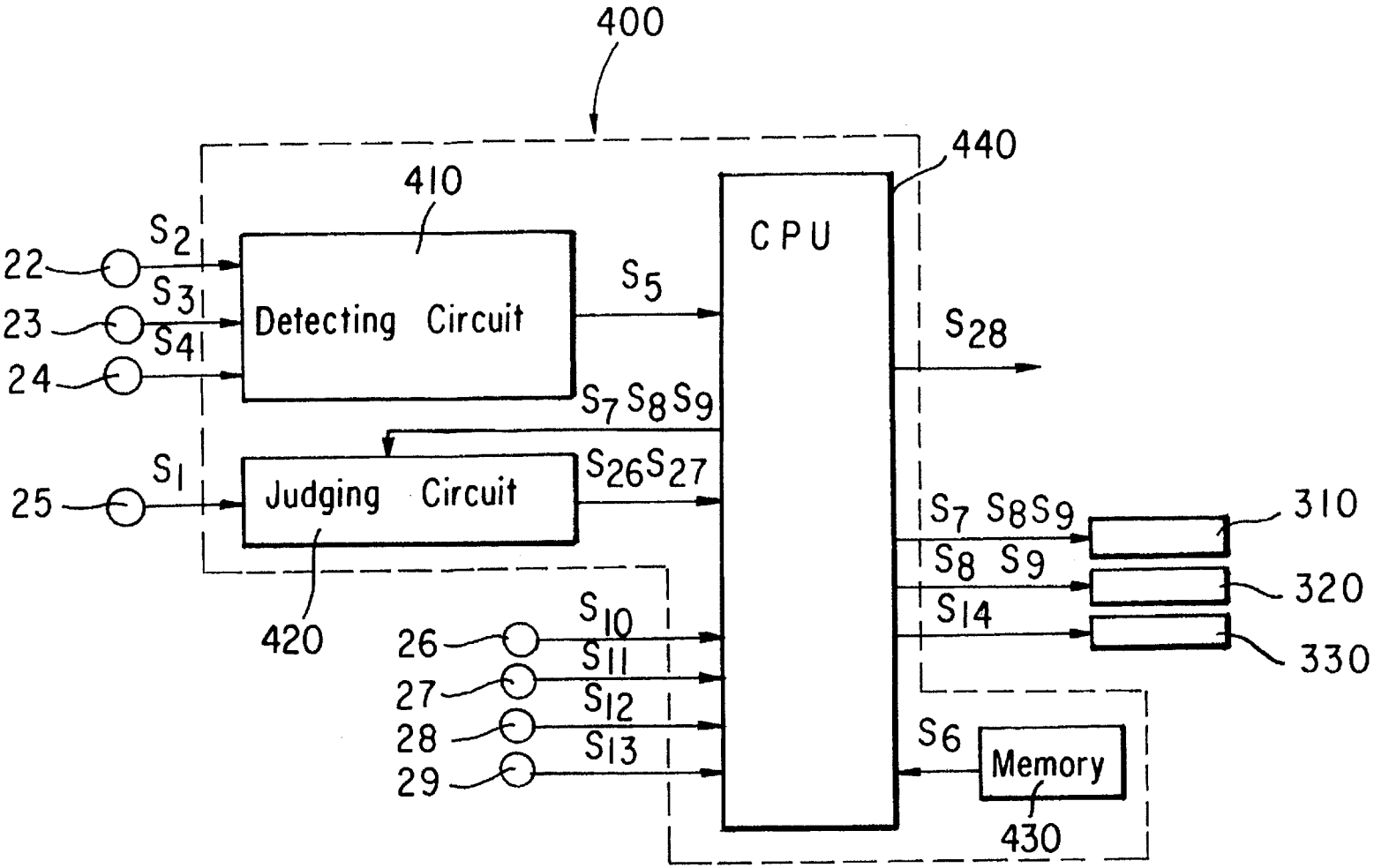
FIG. 9 is a block diagram of a control device for use in the coin selector of the present invention.

With reference to FIG. 9, control device 400 of the coin selector is described in detail. Control device 400 includes detecting circuit 410, judging circuit 420, memory 430 and central processing unit ("CPU") 440. Detecting circuit 410, judging circuit 420, and memory 430 are connected to CPU 440. Detecting circuit 410 is connected to each of first, second and third magnetic detectors 22, 23 and 24 which are illustrated in FIG. 1. Judging circuit 420 is connected to fourth magnetic detector 25 which is illustrated in FIGS. 7 and 8. Memory 430 stores the reference values representing the material composition, thickness and diameter for each denomination of real coins which the vending machine is designed to accept.

The operation of control device 400 in a situation when the coin selector is provided in one monetary system, such as for example, the monetary system in Japan is described below. First, second and third magnetic detectors 22, 23 and 24 detect the material composition, thickness and diameter of deposited object 40 as it passes by the detectors. First through third magnetic detectors 22–24 generate second through fourth electric signals $S_2$–$S_4$ representing the detected composition, thickness and diameter of the deposited object 40, respectively. The second through fourth electric signals $S_2$–$S_4$ are input to detecting circuit 410 from first through third magnetic detectors 22–24, respectively, to be electrically processed therein.

Detecting circuit 410 electrically processes second through fourth electric signals $S_2$–$S_4$, and generates a fifth electric signal $S_5$ which identifiably represents the detected composition, thickness and diameter of deposited object 40. Fifth electric signal $S_5$ is input to CPU 440 from detecting circuit 410 to be electrically processed therein. Whenever CPU 440 receives fifth electric signal $S_5$ from detecting circuit 410, a sixth electric signal $S_6$ identifiably representing the reference values of the composition, thickness and diameter of each of the real coins which the machine is designed to accept, for example, 10 yen, 50 yen, 100 yen and 500 yen coins, is input to CPU 440 from memory 430 to be electrically processed therein. CPU 440 electrically processes fifth and sixth electric signals $S_5$ and $S_6$ to compare the detected composition, thickness and diameter of deposited object 40 with the reference value for those of each of the real coins, to thereby determine whether deposited object 40 is a real coin, and if so, the denomination.

When CPU 440 determines that deposited object 40 is a fake coin, CPU 440 generates a seventh electric signal $S_7$ and outputs it to first solenoid 310 in order to control the movement of first gate 301. When first solenoid 310 receives seventh electric signal $S_7$, the solenoid coil of first solenoid 310 is maintained in the non-excited state, and first gate 301 is controlled to remain in the forward position depicted by the dashed line in FIG. 8. Therefore, real coin chute 32 is blocked so that deposited object 40 is conducted into fake coin chute 31 as depicted by solid arrow ¢A" in FIG. 7.

Alternatively, when CPU 440 determines that deposited object 40 is a real coin of 10 yen or 50 yen, CPU 440 generates an eighth electric signal $S_8$ and outputs it to both first and second solenoids 310 and 320 in order to control the movement of first and second gates 301 and 302. Once first solenoid 310 receives eighth electric signal $S_8$, the solenoid coil of first solenoid 310 is excited so that first gate 301 is moved to the rearward position depicted by the solid line in FIG. 8. This excitement of the solenoid coil of first solenoid 310 is maintained for time period "T" so that first gate 301 also is maintained at the location depicted by the solid line in FIG. 8 for time period "T". In addition, once second solenoid 320 receives eighth electric signal $S_8$, the solenoid coil of second solenoid 320 is also excited so that second gate 302 is moved to the rearward position depicted by the solid line in FIG. 4. This excitement of the solenoid coil of second solenoid 320 also is maintained for time period "T" so that second gate 302 also is maintained at the location depicted by the solid line in FIG. 4 for time period "T". Therefore, deposited object 40, that is, a real 10 or 50 yen coin, is conducted into real coin chute 32 and then into fourth chute 33 as depicted by the dashed arrow "B" in FIG. 7.

Alternatively, if CPU 440 determines that deposited object 40 is a real 100 yen or 500 yen coin, CPU 440 generates a ninth electric signal $S_9$ and outputs it to both first and second solenoids 310 and 320. Once first solenoid 310 receives ninth electric signal $S_9$, the solenoid coil of first solenoid 310 again is excited so that first gate 301 is moved to the position depicted by the solid line in FIG. 8. This excitement of the solenoid coil of first solenoid 310 also is maintained for time period "T" so that first gate 301 is maintained at the position depicted by the solid line in FIG. 8 for time period "T". In addition, when second solenoid 320 receives ninth electric signal $S_9$, second solenoid 320 is maintained in the nonexcited state so that second gate 302 remains in the forward position depicted by a dashed line in FIG. 4, or the solid line in FIG. 7. Therefore, deposited object 40, that is, a real 100 or 500 yen coin is conducted into real coin chute 32 and then into fifth chute 34 as depicted by the dashed arrow "C" in FIG. 7. Further gates which are not shown would be controlled in a similar manner by signals from CPU 440 to further separate the 10 yen coins from the 50 yen coins and the 100 yen coins from the 500 yen coins. The separated coins would be conducted through further chutes into first through fourth containers.

First through fourth phototubes 26–29 which have been discussed in the description of the prior art are connected to CPU 440. First phototube 26 generates a tenth electric signal $S_{10}$ whenever the first container is filled with real coins of 10 yen. Second phototube 27 generates an eleventh electric signal $S_{11}$ whenever the second container is filled with real coins of 50 yen. Third phototube 28 generates a twelfth electric signal $S_{12}$ whenever the third container is filled with real coins of 100 yen. Fourth phototube 29 generates a thirteenth electric signal $S_{13}$ whenever the fourth container is filled with real coins of 500 yen. The tenth through thirteenth electric signals $S_{10}$–$S_{13}$ are input to CPU 440 from the respective first through fourth phototubes 26–29 to be electrically processed therein.

When CPU 440 determines that deposited object 40 is a real coin of 10 yen, 50 yen, 100 yen or 500 yen while CPU also receives at least one of the tenth through thirteenth electric signals $S_{10}$–$S_{13}$, CPU 440 generates a fourteenth electric signal $S_{14}$ and outputs it to third solenoid 330 which is associated with a fifth gate, which has been already discussed in the description of the prior art. When the third solenoid 330 receives the fourteenth electric signal $S_{14}$, the solenoid coil of third solenoid 330 is excited so that the movement of the fifth gate is controlled to conduct the real coin into an over-flow container via a sixth chute, as discussed in the description of the prior art.

Figure 10:
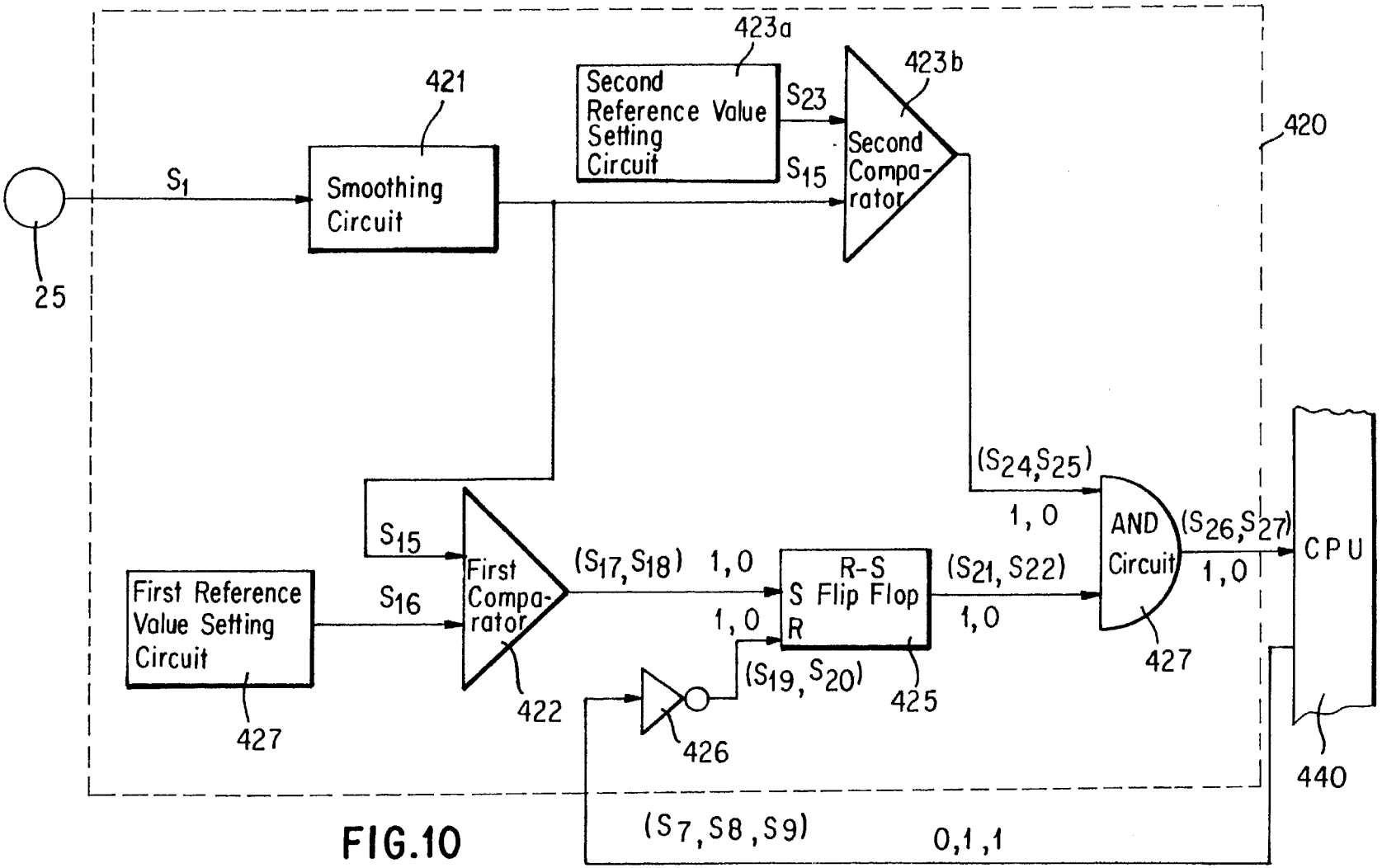
FIG. 10 is a block diagram of a judging circuit shown in FIG. 9.

As discussed above, fourth magnetic detector 25 continually generates and detects the condition of the magnetic flux path and continually generates first electric signal $S_1$ which is representative of this condition. First electric signal $S_1$ is input into smoothing circuit 421 from fourth magnetic detector 25 as shown in FIG. 10. Smoothing circuit 421 smoothes first electric signal $S_1$ as shown in FIG. 11, and generates fifteenth electric signal $S_{15}$ representing the smoothed first electric signal $S_1$.

Figure 11:
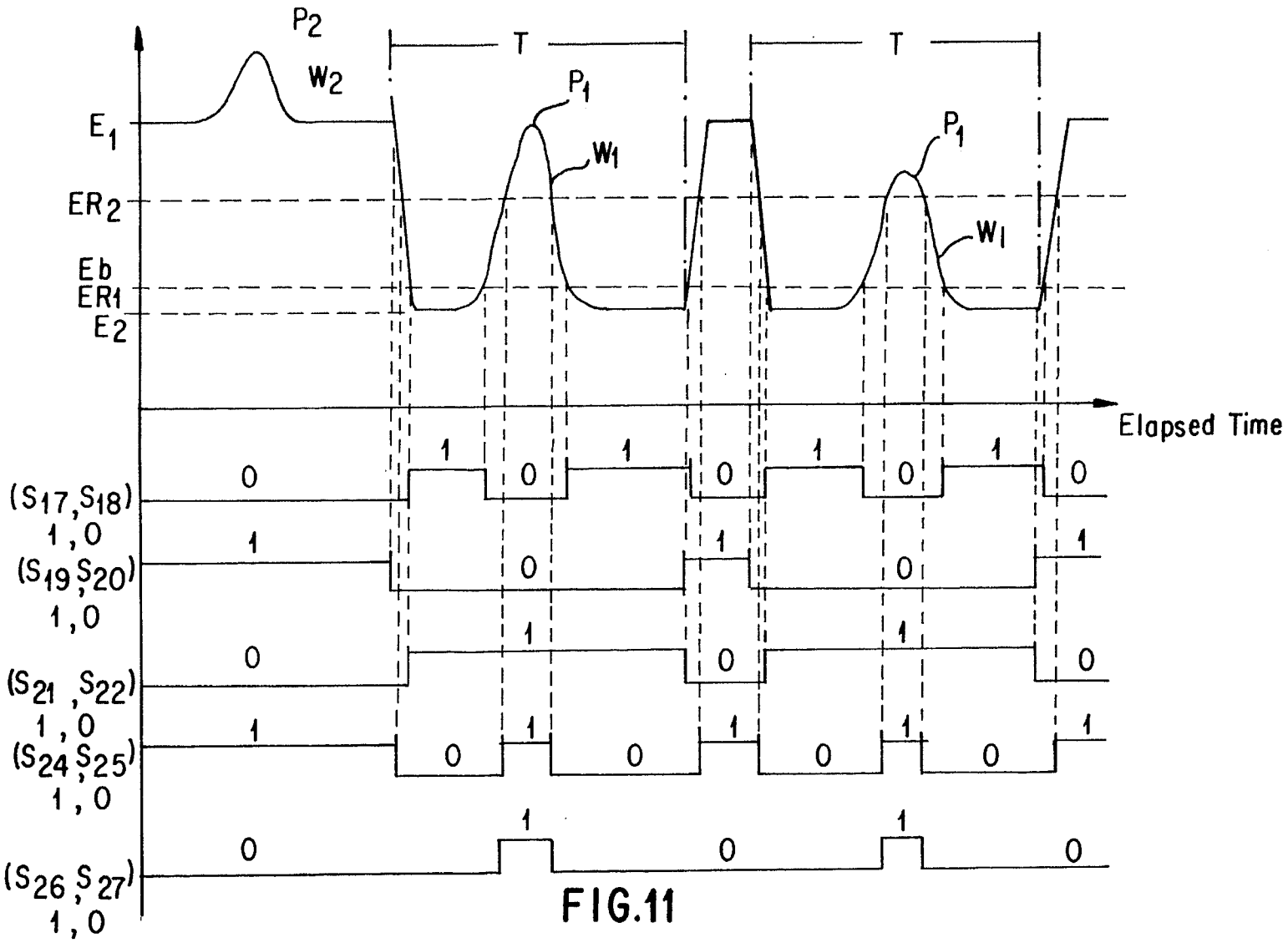
FIG. 11 is a graph illustrating a characteristic of a plurality of electric signals electrically processed at a control device of the present invention.

With reference to FIG. 11, when CPU 440 determines that deposited object 40 is a fake coin, seventh electric signal $S_7$ is input into first solenoid 310. When first solenoid 310 receives seventh electric signal $S_7$, the solenoid coil of first solenoid 310 is maintained in the non-excited state so that first gate 301 is maintained at the forward position depicted by the dashed line in FIG. 8, thereby conducting deposited object (fake coin) 40 into fake coin chute 31. In this situation, first gate 301 is located at a position which is closest to fourth magnetic detector 25 so that the voltage of fifteenth electric signal $S_{15}$ is maintained at value $E_1$. When deposited object 40 passes by fourth magnetic detector 25, fifteenth electric signal $S_{15}$ has a pike $W_2$ having peak $P_2$. However, as explained below, peak values $P_2$ are not relevant to the determinations of whether real coins are, in fact, conducted into the real coin chute.

When CPU 440 determines that deposited object 40 is a real coin, either eighth electric signal $S_8$ or ninth electric signal $S_9$ is input into first solenoid 310. When first solenoid 310 receives either eighth electric signal $S_8$ or ninth electric signal $S_9$, the solenoid coil of first solenoid 310 is excited so that first gate 301 is quickly moved from the forward position depicted by the dashed line in FIG. 8 to the rearward position depicted by the solid line in FIG. 8, and conducts deposited object (real coin) 40 into real coin chute 32. Thus, first gate 301 is quickly moved to a position which is furthest away from fourth magnetic detector 25 from the closest position so that the voltage of fifteenth electric signal $S_{15}$ is sharply decreased from value $E_1$ to value $E_2$. The excitement of the solenoid coil of first solenoid 310 is maintained for a time period "T" so that first gate 301 is maintained at the position depicted by the solid line in FIG. 8 for time period "T". As a result, the voltage of fifteenth electric signal $S_{15}$ is maintained at value $E_2$ for time period "T". However, when deposited object (real coin) 40 passes by fourth magnetic detector 25, fifteenth electric signal $S_{15}$ has pike $W_1$ having peak $P_1$. Since real coin 40, which will be conducted into real coin chute 32, passes by fourth magnetic detector 25 under various conditions, for example, at various inclinations or speeds, the value of peak $P_1$ varies. Statistically, the value of the peak $P_1$ varies in a range shown by the vertical solid line in FIG. 12, for each coin denomination.

After time period "T" has elapsed frown when first solenoid 310 receives either eighth electric signal $S_8$ or ninth electric signal $S_9$, the solenoid coil of first solenoid 310 returns to the non-excited state. Therefore, first gate 301 is quickly moved from the rear position depicted by the solid line in FIG. 8 to the forward position depicted by the dashed line in FIG. 8. Thus, first gate 301 is quickly moved to the position closest to fourth magnetic detector 25 from the position which is furthest away from fourth magnetic detector 25, and the voltage of fifteenth electric signal $S_{15}$ is sharply increased to value $E_1$ from $E_2$. First solenoid 310 is on standby to receive the next discriminating signal from CPU 440.

As explained, with the exception of when an object passes by detector 25, the voltage level of fifteenth electric signal $S_{15}$ is stable at $E_1$ or $E_2$, depending upon the location of gate 301. The voltage value shifts between values $E_1$ and $E_2$ in response to the changes in the position of first gate 301. When a coin passes by detector 25, the voltage level has a peak depending on the location of the coin relative to the detector, and the denomination of the coin. When the voltage value of signal $S_{15}$ is equal to $E_2$, gate 301 must be in the rearward (real coin) location.

With reference to FIG. 10, judging circuit 420 includes smoothing circuit 421, first comparator 422, second comparator **423*b*, first reference value setting circuit 424, second reference value setting circuit 423*a*, R-S flip-flop 425, inverter 426 and AND circuit 427. The relationship between the above elements and the operation manner of judging circuit 420 are described in detail below. Smoothing circuit 421 is connected to both first comparator 422 and second comparator 423*b* so that fifteenth electric signal $S_{15}$ generated at smoothing circuit 421 is output to both first comparator 422 and second comparator 423*b*. First comparator 422 is further connected to first reference value setting circuit 424 which generates sixteenth electric signal S16** representing a first reference value $ER_1$.

With reference to FIGS. 8 and 11, the first reference value $ER_1$ is selected to be equal to or lower than boundary value Eb. Boundary value voltage level Eb corresponds to the situation where first gate 301 is located at the rearward position depicted by the solid line in FIG. 8, that is, to allow real coin 40 to be conducted into real coin chute 32, and real coin 40 is disposed at a position at which it begins to be conducted into the real coin chute.

With further reference to FIG. 10, first comparator 422 electrically processes and compares the fifteenth and sixteenth electric signals $S_{15}$ and $S_{16}$ output from smoothing circuit 421 and first reference value setting circuit 424, respectively, and determines whether the voltage of fifteenth electric signal $S_{15}$ is equal to or lower than first reference value $ER_1$. When the voltage of fifteenth electric signal $S_{15}$ is equal to or lower than first reference value $ER_1$, seventeenth electric signal $S_{17}$ which is a binary signal having level "1" is generated at first comparator 422. With reference to FIGS. 8 and 11, this situation would occur just after first gate 301 is moved to the rearward position shown in the solid lines to conduct the object 40 into real coin chute 32, that is, after CPU determines object 40 is a real coin of any denomination. On the other hand, when the voltage of fifteenth electric signal $S_{15}$ is higher than first reference value $ER_1$, an eighteenth electric signal $S_{18}$ which is a binary signal having level "0" is generated at first comparator 422. This situation would indicate that gate 301 is in the position shown in dashed lines, which occurs initially only before an object is detected or when the object is determined to be a fake coin.

Seventeenth and eighteenth electric signals $S_{17}$ and $S_{18}$ generated at first comparator 422 are input into terminal "S" of R-S flip-flop 425. Terminal "R" of R-S flip-flop 425 is connected to an output terminal of inverter 426. An input terminal of inverter 426 is connected to CPU 440 to receive the seventh through ninth electric signals $S_7$–$S_9$ therefrom. Seventh electric signal $S_7$ is a binary signal having a level "0", which, as discussed above, occurs when object 40 is determined by CPU to be a fake coin, and which causes the solenoid coil of first solenoid 310 to be in the non-excited state, to thereby conduct the fake coin into the fake coin chute. Both eighth and ninth electric signals $S_8$ and $S_9$ are a binary signal having a level "1" which occurs when object 40 is determined by CPU 40 to be a real coin, and causes solenoid coil of first solenoid 310 to be excited. Inverter 426 electrically processes seventh through ninth electric signals $S_7$–$S_9$ so as to reverse the level of the binary signals. As a result, seventh electric signal $S_7$ is changed to nineteenth electric signal $S_{19}$ which is a binary signal having the level "1". Eighth and ninth electric signals $S_8$ and $S_9$ are changed to twentieth electric signal $S_{20}$ which is a binary signal having the level "0". Nineteenth and twentieth electric signals $S_{19}$ and $S_{20}$ generated at inverter 426 are input to the terminal "R" of R-S flip-flop 425, with signal $S_{19}$ indicating a fake coin and signal $S_{20}$ indicating a real coin.

The operation manner of R-S flip-flop 425 is as follows. With reference to FIGS. 10 and 11, initially terminal "S" of R-S flip flop 425 will receive signal $S_{18}$ having level "0" and terminal "R" will receive signal $S_{19}$ having level "1", and the output of flip-flop 425 is twenty-second electric signal $S_{22}$ having level "0". No object has been detected at this time. When terminal "S" of R-S flip-flop 425 receives seventeenth electric signal $S_{17}$ which is the binary signal having level "1" while the terminal "R" of R-S flip-flop 425 receives the twentieth electric signal $S_{20}$ which is the binary signal having level "0", R-S flip-flop 425 generates a twenty-first electric signal $S_{21}$ which is a binary signal having a level "1". As long as the terminal "R" of R-S flip-flop 425 continues to receive the twentieth electric signal $S_{20}$ which is the binary signal having level "0", R-S flip-flop 425 continually generates the twenty-first electric signal $S_{21}$ which is the binary signal having a level "1". Once the terminal "R" of R-S flip-flop 425 receives the nineteenth electric signal $S_{19}$ which is the binary signal having level "1", that is, after expiration of time period "T", R-S flip-flop 425 generates twenty-second electric signal $S_{22}$ which is a binary signal having a level "0". Twenty-first and twentysecond second electric signals $S_{21}$ and $S_{22}$ generated at R-S flip-flop 425 are input into AND circuit 427 to be electrically processed therein. AND circuit 427 further receives twenty-fourth and twenty-fifth electric signals $S_{24}$ and $S_{25}$ from second comparator **423*b***, as discussed below.

Level "1" signal $S_{17}$ can only be outputted by first comparator 422 after signal $S_{15}$ becomes less than $ER_1$, and this only occurs when gate 301 actually is in the rear position to conduct a coin to a real coin chute 32, that is, in the real coin position. Further, it is only when signal $S_{17}$ is inputted to the S terminal of flip-flop 425 at a time after signal $S_{20}$ is inputted to the R terminal of flip-flop 425, that flip-flop 425 outputs level "1" signal $S_{21}$. Signal $S_{20}$ indicates a real coin has been inserted into the coin selector. Thus, when a real coin has been inserted into the coin selector and detected, it can be concluded, if flip-flop 425 also outputs a level "1" signal, that gate 301 actually is in the real coin position.

Figure 12:
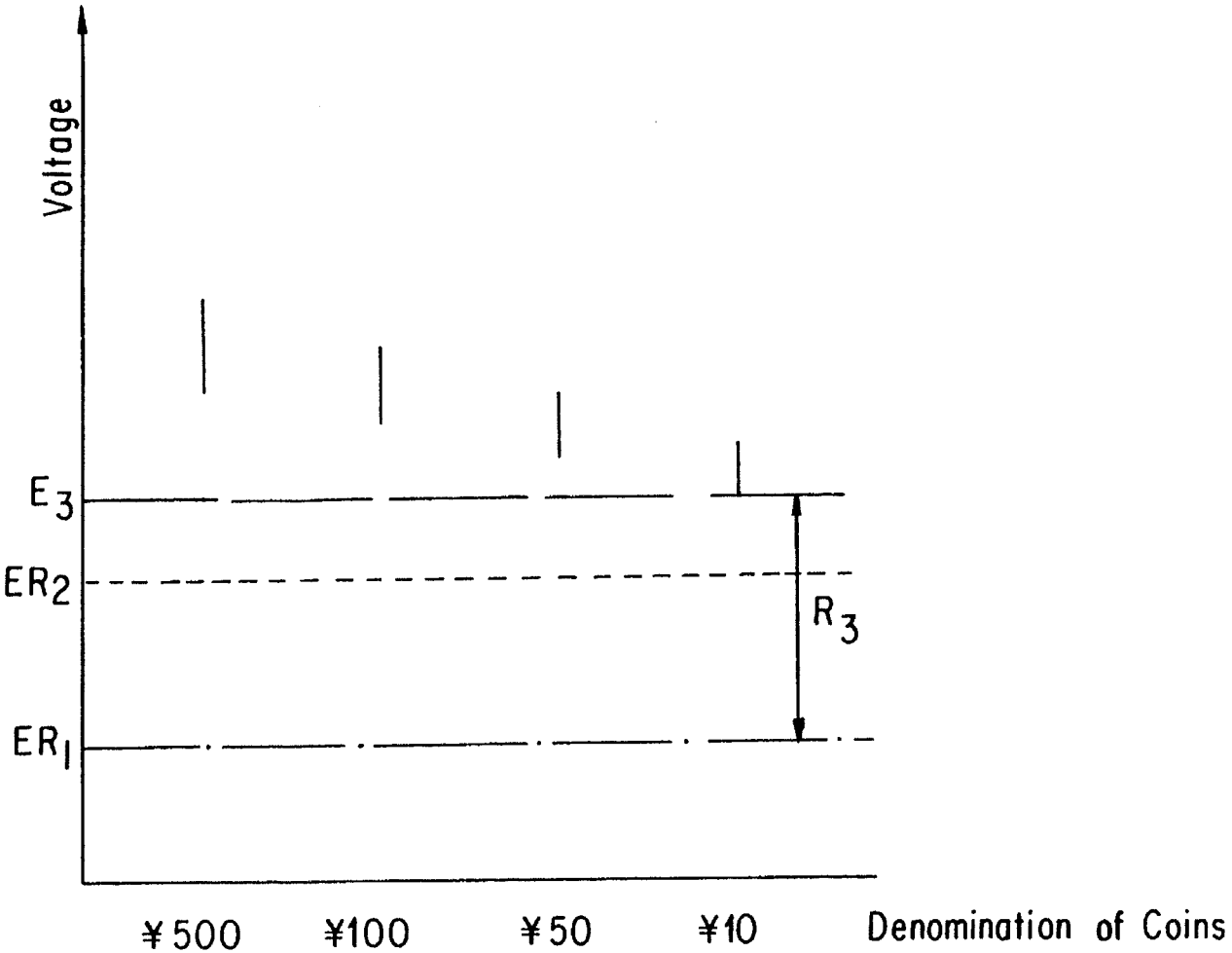
FIG. 12 is a graph illustrating a statistical result of one characteristic shown in FIG. 11.

With reference to FIGS. 10–12, the operation manner of second reference value setting circuit **423*a* and second comparator 423*b* are described in detail below. Second reference value setting circuit 423*a* generates twenty-third electric signal. $S_{23}$ representing second reference value $ER_2$ which is selected within range $R_3$. With reference to FIG. 12, the range $R_3$ is defined as follows. The highest value of range $R_3$ is lower than the statistical lowest value of peak $P_1$ of pike $W_1$ for a real coin of 10 yen, and the lowest value of range $R_3$ is higher than first reference value $ER_1$. Twenty-third electric signal $S_{23}$ is input to second comparator 423b. Second comparator 423b electrically processes fifteenth electric signal $S_{15}$ sent from smoothing circuit 421 and twenty-third electrical signal $S_{23}$ sent from circuit 423a** so as to judge whether the voltage of fifteenth electric signal $S_{15}$ is greater than the second reference value $ER_2$.

When second comparator 423b judges that the voltage of fifteenth electric signal $S_{15}$ is higher than the second reference value $ER_2$, second comparator 423b generates a twenty-fourth electric signal $S_{24}$ which is a binary signal having level "1". With reference to FIG. 11, this situation occurs, initially, when gate 301 is in the forward position to conduct coins to the fake coin chute, that is, the fake coin position. On the other hand, when second comparator 423b judges that the voltage of fifteenth electric signal $S_{15}$ is equal to or lower than the second reference value $ER_2$, second comparator 423b generates a twenty-fifth electric signal $S_{25}$ which is a binary signal having level "0". This situation occurs when the object is detected and determined to be a real coin, and gate 301 is moved to the real coin position. However, when a coin moves by detector 25 when gate 301 is in the real coin position, pike $W_1$ occurs, and signal $S_{15}$ again will exceed reference value $ER_2$, and signal $S_{24}$ having a level "1" will be outputted. Second comparator 423b outputs signal $S_{24}$ only when gate 301 is in the fake coin position, or when gate 301 is in the real coin position and a coin moves by detector 25. Thus, if it is known that gate 301 is in the real coin position, second comparator 423b confirms whether the coin actually is conducted into the real coin chute.

Twenty-fourth and twenty-fifth electric signals $S_{24}$ and $S_{25}$ generated at second comparator 423b are input to AND circuit 427 to be electrically processed therein. Therefore, AND circuit 427 electrically processes twenty-first and twenty-second electric signals $S_{21}$ and $S_{22}$ from R-S flip-flop 425 and twenty-fourth and twenty-fifth electric signals $S_{24}$ and $S_{25}$ from second comparator 423b. As shown by FIG. 11, so long as AND circuit 427 receives both the twenty-first and twenty-fourth electric signals $S_{21}$ and $S_{24}$ which are both the binary signal having level "1", AND circuit 427 generates twenty-sixth electric signal $S_{26}$ which is a binary signal having level "1". Twenty-sixth electric signal *S26* represents a judgment that deposited object 40 has been conducted into real coin chute 32. 0n the other hand, whenever AND circuit 427 receives any other combination of two binary signals which are not both level "1", that is, if either or both of the signals is $S_{22}$ (level "0") or $S_{25}$ (level "0"), AND circuit 427 generates twenty-seventh electric signal $S_{27}$ which is a binary signal having level "0". Twenty-seventh electric signal $S_{27}$ represents a judgment that deposited object 40 has not been conducted into real coin chute 32.

Twenty-sixth and twenty-seventh electric signals $S_{26}$ and $S_{27}$ generated at AND circuit 427 are input into CPU 440 to be electrically processed therein. When CPU 440 determines that deposited object 40 is a real coin, based upon the comparison of signals $S_5$ and $S_6$ as discussed above, and receives twenty-sixth electric signal $S_{26}$ which indicates that the coin has been conducted into the real coin chute 32, CPU 440 generates twenty-eighth electric signal $S_{28}$. Twenty-eighth electric signal $S_{28}$ generated at CPU 440 is input into a display (not shown) to show an addition of the value of the real coin to the previous value of the coins which have been conducted into real coin chute 32. However, if signal $S_{27}$ is received by CPU 440 indicating a real coin has been returned to the customer via the fake coin chute, the value of the coin is not credited.

Since the output of second comparator 423b and R-S flip-flop 425 are inputted to AND circuit 427, it is only when both of these output signals are at level "1" that the output of AND circuit 427 will be a signal at level "1". As discussed, a level "1" signal output by second comparator 423b confirms that, if gate 301 is in the real coin position, the coin will be conducted into the real coin chute. A level "1" signal output by flip-flop 425 confirms, when a real coin is detected, that gate 301 is in the real coin position. Since both second comparator 423b and R-S flip-flop 425 must output a level "1" signal for AND circuit 427 to output a level "1" signal to CPU 440, AND circuit 427 will only output a level "1" signal when the coin actually is conducted into the real coin chute. AND circuit 427 will not output a level "1" signal where gate 301 is not moved to the real coin position, or where the coin is not detected at the entrance to real coin chute 32 when gate 301 is in the real coin position. Accordingly, CPU 440 will not erroneously credit the customer with the value of an inserted coin which has been returned to the customer.

With reference to FIG. 12, the coin selector including a judging circuit according to the invention only requires that reference value $ER_2$ be selected to be less than $E_3$ (the signal corresponding to the lowest statistically possible value for a real coin) and greater than reference value $ER_1$. $ER_1$ only need be selected to be greater than $E_2$, which corresponds to the situation when gate 301 is move to the real coin position to allow the coin to be conducted into the real coin chute, that is, when CPU 440 determines a real coin has been inserted, but the coin has not yet passed by detector 25. $E_2$ and thus $ER_1$ are not dependent upon the statistically greatest possible value for a detected coin moving by detector 25 when gate 301 is in the fake coin position. Thus, unlike the prior art, range $R_3$ of possible values for second reference value $ER_2$ is not dependent upon the peak values $P_2$ for coins moving by detector 25 when gate 301 is not in the real coin position, and easily can be determined, even where the coin selector is used with many different currency systems having a large number of coins.

This invention has been described in detail in connection with the preferred embodiment. This embodiment, however, is merely for example only and the invention is not restricted thereto. It will be understood by those skilled in the art that other variations and modifications can easily be made within the scope of this invention as defined by the appended claims.

We claim:

1. A coin selector including:

a coin chute into which coins deposited into said coin selector are initially conducted at an entry portion, said coin chute divided at a location below said entry portion into a real coin chute and a fake coin chute;

discriminating means for discriminating between real coins and fake coins which are deposited into said coin selector and for outputting an operational result indicating whether the deposited coin is real or fake;

conducting means for conducting the coin into either the real coin chute or the fake coin chute, said conducting means located at a position above the location where the real coin chute and the fake coin chute are divided, said conducting means movable between a first position in which the coin is conducted into the real coin chute and a second position in which the coin is conducted into the fake coin chute in dependence upon the operational result of said discriminating means;

detecting means for detecting an operational condition of said conducting means and a moving condition of the deposited coin at a time when the deposited coin passes by the location where the coin chute is divided, said detecting means outputting a signal indicative of the operation condition and the moving condition;

first comparing means for comparing a predetermined first reference condition with the operational condition of the conducting means and outputting an operational result of the comparison;

second comparing means for comparing a predetermined second reference condition with the moving condition of the deposited coin and outputting an operation result of the comparison; and judging means functioning when a real coin is deposited, said judging means for receiving the operational result of said first comparing means and the operational result of said second comparing means, said judging means outputting a signal indicating whether the deposited real coin is conducted into the real coin chute based upon the moving condition of the coin and the operational condition of the conducting means.

2. The coin selector recited in claim 1, wherein, the operating condition outputted by said detecting means depends upon whether said conducting means is in the first position or the second position, and the moving condition outputted by said detecting means depends upon the position of the coin relative to said detecting means when the coin moves by the divided location of said coin chute, the operational result of the first comparing means is a signal indicating whether said conducting means is in the first position or the second position, the operational result of said second comparing means when a real coin is deposited is a signal indicating whether the real coin will move into the real coin chute, and the signal outputted by said judging means indicates the coin is conducted into the real coin chute only when said first comparing means outputs a signal indicating the conducting means is in the first position and the second comparing means outputs a signal indicating the coin will move into the real coin chute.

3. The coin selector recited in claim 1, said conducting means including a blocking member located at the position above the divided location of said coin chute, said blocking member movable between the first and second positions, wherein, when in said second position said blocking member blocks said real coin chute.

4. The coin selector recited in claim 3, said conducting means including a solenoid, said blocking member comprising a gate member, said solenoid controlling the position of said gate member to be in the first position or the second position.

5. The coin selector recited in claim 4, said solenoid including a cylindrical plunger made of magnetic material and a coiled spring resiliently disposed about said plunger.

6. The coin selector recited in claim 5, said cylindrical plunger fixedly connected to said gate member, the resiliency of said coiled spring urging said gate member into said second position, said gate member reciprocatingly moved in response to operation of said solenoid such that when said solenoid is excited, said gate member is moved into said first position against the resiliency of said coiled spring.

7. The coin selector recited in claim 6, said detecting means including a magnetic detector.

8. The coin selector recited in claim 7, said magnetic detector located on a prolongation of the longitudinal axis of said cylindrical plunger.

9. The coin selector recited in claim 1, said first and second comparing means each comprising a comparator.

10. The coin selector recited in claim 1, said judging means comprising an AND circuit.

11. A coin selector comprising:

a coin chute having an entry portion into which coins deposited into said coin selector are initially conducted, said coin chute divided at a predetermined location at the lower end of said entry portion into a real coin path and a fake coin path;

determining means for determining whether a deposited coin is a real coin or a fake coin;

a gate member located at a position above the predetermined location, said gate member movable between a first position which causes coin to be conducted to the real coin path and a second position which causes coins to be conducted to the fake coin path; and judging means coupled to said determining means for ascertaining whether a deposited real coin is conducted into the real coin path, and providing an output signal in accordance therewith, said judging means includes:

a magnetic detector disposed above the predetermined location for detecting the passing of an inserted coin;

a first comparator linked to an output of said magnetic detector;

a second comparator linked to an output of said magnetic detector;

a flip-flop circuit linked to an output of said first comparator; and an AND circuit linked to the output of both said second comparator and said flip-flop circuit.

12. The coin selector recited in claim 11, said gate member blocking the real coin path in the second position and not blocking the real coin path in the first position.

13. The coin selector recited in claim 12 said determining means comprising:

detecting means for detecting characteristics of a deposited coin and outputting a signal corresponding to the detected characteristics; and a central processing unit receiving the output signal of said detecting means and comparing the signal to stored reference values to determining whether the coin is real or fake, said central processing unit outputting a signal to said gate member to cause said gate member to be in the first position when the coin is determined to be real.

14. The coin selector recited in claim 13, said central processing unit also determining the denomination of said coin based upon the output signal of the detecting means.

15. The coin selector recited in claim 13, said detecting means comprising a plurality of additional magnetic detectors which detect characteristics of the coin and output signals indicative of the detected characteristics, and a detecting circuit which receives the output signals from the additional magnetic detectors and outputs signal indicative of the detected characteristics to the central processing unit.

16. The coin selector recited in claim 13, said flip-flop circuit comprising an R-S flip-flop, said signal outputted by said central processing unit also inputted to a first input of said flip-flop circuit through an inverter, the output of said first comparator inputted to a second input of said flip-flop.

17. The coin selector recited in claim 13, the output of said AND circuit inputted to said central processing unit.

18. The coin selector recited in claim 11 further comprising a first reference value setting circuit and a second reference value setting circuit, an output of said first reference value setting circuit linked to an input of said first comparator and an output of said second reference value setting circuit linked to an input of said second comparator.

* * * * *